US006327860B1

(12) United States Patent
Critchley

(10) Patent No.: US 6,327,860 B1
(45) Date of Patent: Dec. 11, 2001

(54) FUEL INJECTOR FOR LOW EMISSIONS PREMIXING GAS TURBINE COMBUSTOR

(75) Inventor: Ian L. Critchley, Phoenix, AZ (US)

(73) Assignee: Honeywell International, Inc., Morris Township, NJ (US)

( * ) Notice: Subject to any disclaimer, the term of this patent is extended or adjusted under 35 U.S.C. 154(b) by 0 days.

(21) Appl. No.: 09/598,744

(22) Filed: Jun. 21, 2000

(51) Int. Cl.[7] ..... F23R 3/30
(52) U.S. Cl. ..... 60/737; 60/746
(58) Field of Search ..... 60/39.463, 39.465, 60/737, 740, 742, 746

(56) References Cited

U.S. PATENT DOCUMENTS 3,765,824 * 10/1973 Trozzi ..... 431/188
4,356,698 * 11/1982 Chamberlain ..... 60/737
5,070,700 12/1991 Mowill .
5,081,832 1/1992 Mowill .
5,156,002 10/1992 Mowill .
5,377,483 1/1995 Mowill .
5,572,862 11/1996 Mowill .
5,613,357 3/1997 Mowill .
5,628,182 5/1997 Mowill .
5,638,674 6/1997 Mowill .
5,927,076 * 7/1999 Pillsbury ..... 60/737

* cited by examiner

*Primary Examiner*—Louis J. Casaregola
(74) *Attorney, Agent, or Firm*—Robert Desmond, Esq.

(57) ABSTRACT

The present invention provides a premix fuel injector for use in gas turbine engines and in combustion systems having controllable pressure drops. The premix fuel injector comprises a premix chamber having an inlet for receiving a flow of pressurized air and having an exit. A venturi is coupled to the exit of the premix chamber and an inlet of a combustion chamber. Gaseous fuel is flowed into the premix chamber by a plurality of circumferentially disposed tubes extending into the premix chamber with each of said tubes having at least one hole for flowing a stream of the gaseous fuel.

20 Claims, 10 Drawing Sheets

FUEL INJECTOR FOR LOW EMISSIONS PREMIXING GAS TURBINE COMBUSTOR

TECHNICAL FIELD

This invention relates generally to low emission combustion systems used in gas turbine engines and in particular to fuel injectors for use in such systems.

BACKGROUND OF THE INVENTION

Gas turbine engines of the type used for industrial applications may employ combustor systems designed to minimize nitrogen oxide emissions. One such combustor system, disclosed in U.S. Pat. No. 5,481,866, entitled Single Stage Premixed Constant Fuel/Air Ratio Combustor, issued to Mowill on Jan. 9, 1996, is incorporated herein by reference to the extent necessary for a full understanding of such a combustor. The '866 patent discloses a combustor having an externally cooled non-perforated combustor liner that receives all combustion air from a venturi shaped premixer. Excess air that does not enter the combustor through the premixer is ducted so as to externally cool the combustor liner, and eventually re-enters the flowpath downstream of the combustion region through dilution ports. An air valve is used to directly control the amount of air supplied to the premixer so as to minimize nitrous oxide emissions at all power settings. The air valve has the effect of indirectly controlling the amount of air routed to the dilution ports.

A problem occurs when combustors of the type disclosed in the '866 patent are used in conjunction with an engine having a compressor with a relatively high compression ratio. At low engine power settings, the air valve used to control air to the premixer is mostly closed forcing most of the compressed air through the dilution ports. Although engine power is reduced, the total volume of air being pumped by the compressor at low power or idle settings remains high, resulting in a substantial increase in dilution airflow at reduced power. However, the dilution ports are necessarily sized to provide adequate backflow margin at the lower flow, higher power settings. Thus at reduced power, higher dilution flow conditions, the dilution ports overly restrict the dilution airflow causing a larger than desired pressure drop across the combustor and a loss of engine efficiency.

One solution has been to provide a separate apparatus for varying the flow area of the dilution ports at different power settings in addition to an air valve for controlling air to the premixer. A disadvantage is that such apparatus are typically very complex, adding significantly to the total cost of the combustor system.

Another solution is disclosed in the copending U.S. patent application Ser. No. 08/966,393, filed Nov. 7, 1997 which is assigned to the assignee of this application. The '393 application discloses a combustor dilution bypass system that includes an air valve and a low pressure drop combustor bypass duct. The air valve simultaneously controls both the supply of air to the premixer, and the amount of air directed into a large bypass duct. Air entering the bypass duct is reintroduced into the gas flowpath as dilution air downstream of the primary combustion zone. At low power settings the air valve directs most of the air to the bypass duct, in effect adding dilution flow to that provided through the fixed area dilution ports, whereby the pressure drop across the combustor may be controlled at an optimal level.

Notwithstanding the amount of air being bypassed, to achieve low emission there is a need to have the fuel and air thoroughly mixed in the premix injector prior to the mixture entering the combustion chamber. Failure to mix the fuel and air results in fuel rich and/or fuel lean concentrations in the combustion chamber. These concentrations lead to local flame temperatures that depart from the optimum for the minimum production of carbon monoxide and nitrogen oxides. The eventual burning of these rich concentrations results in the generation of hot regions which produce nitrogen oxides and can damage turbine components downstream of the combustor. The lean concentrations promote incomplete combustion and production of carbon monoxide and unburned hydrocarbons. This is especially a concern where the fuel is a gas as opposed to a liquid. Because a gaseous fuel will have very low momentum when injected, the compressed air with which it needs to mix can in affect trap the gas and prevent it from mixing.

Accordingly, a need exists in a low emissions combustor for a premix fuel injector that thoroughly mixes gaseous fuel and air before injecting the mixture into the combustion chamber.

SUMMARY OF THE INVENTION

An object of the present invention is to provide a premix fuel injector that mixes gaseous fuel and air before injecting the mixture into the combustion chamber.

Another object of the present invention is to provide a gas turbine engine having such a premix fuel injector.

Yet another object of the present is to provide a premix fuel injector for use in a combustion system having controllable pressure drops.

The present invention achieves these objects by providing a premix fuel injector with a premix chamber having an inlet for receiving a flow of pressurized air and having an exit. A venturi is coupled to the exit of the premix chamber and an inlet of a combustion chamber. Gaseous fuel is flowed into the premix chamber by a plurality of circumferentially disposed tubes extending into the premix chamber with each of said tubes having at least one hole for flowing a stream of the gaseous fuel.

These and other objects, features and advantages of the present invention are specifically set forth in or will become apparent from the following detailed description of a preferred embodiment of the invention when read in conjunction with the accompanying drawings.

DESCRIPTION OF THE PREFERRED EMBODIMENT

Figure 1:
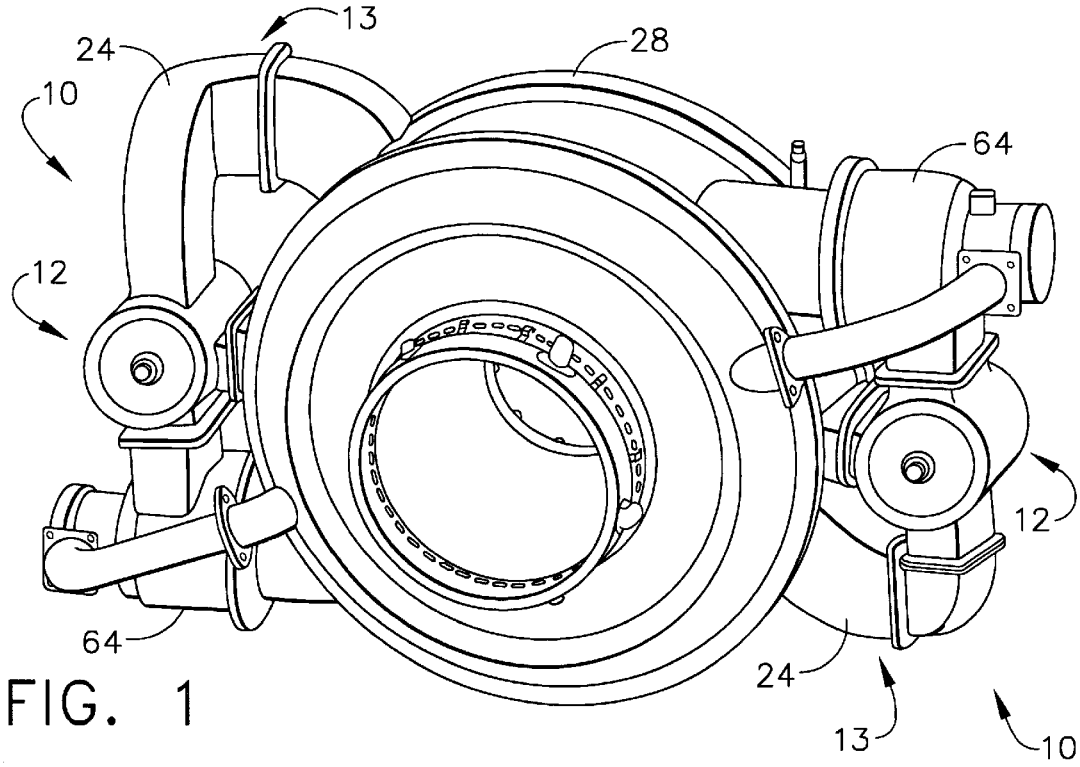
FIG. 1 depicts a perspective view of a low emissions combustion system with two dilution bypass systems as contemplated by the present invention.

Referring to FIG. 1 the bypass system of the subject invention is indicated generally by the numeral 10. The bypass system 10 includes an air valve 12 connected to a combustor bypass 13. In the preferred embodiment, two bypass systems 10 are used, one on each side of the combustor and spaced about 180 degrees apart. A different number or arrangement of bypass systems than what is shown here may be preferable depending on the particular engine and application.

Figure 2:
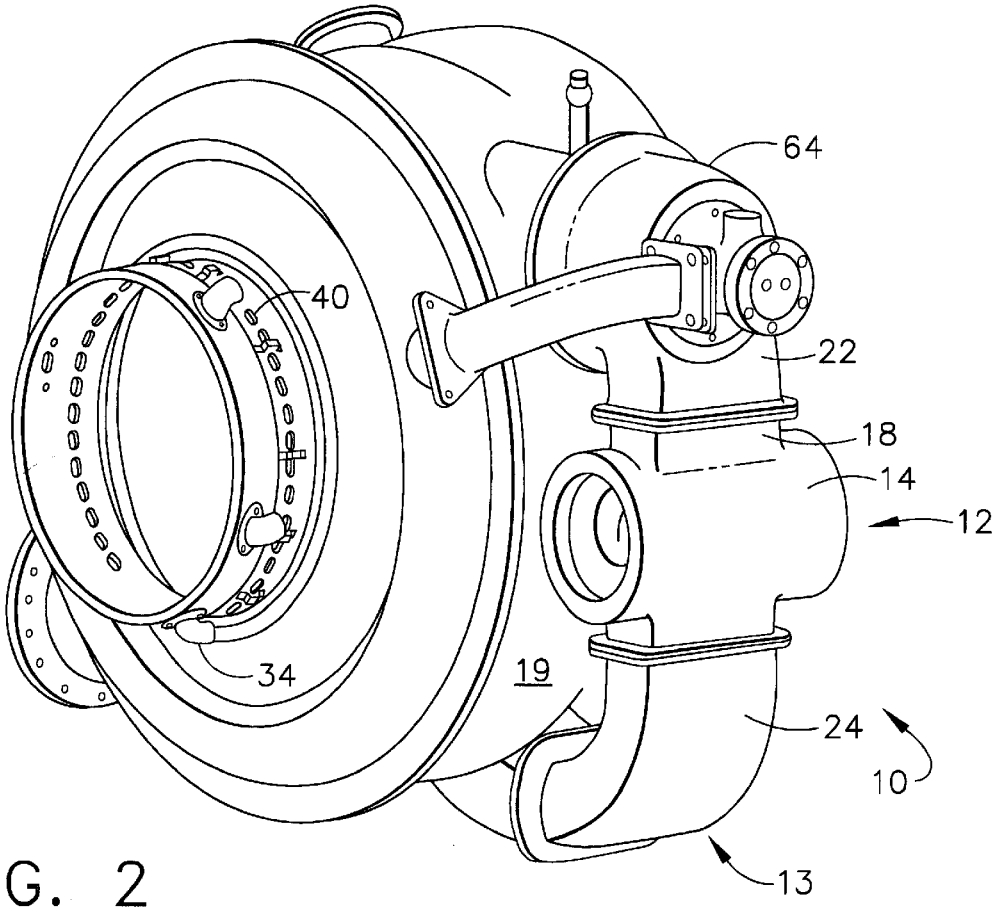
FIG. 2 depicts the combustion system of FIG. 1 from a different perspective.
Figure 3:
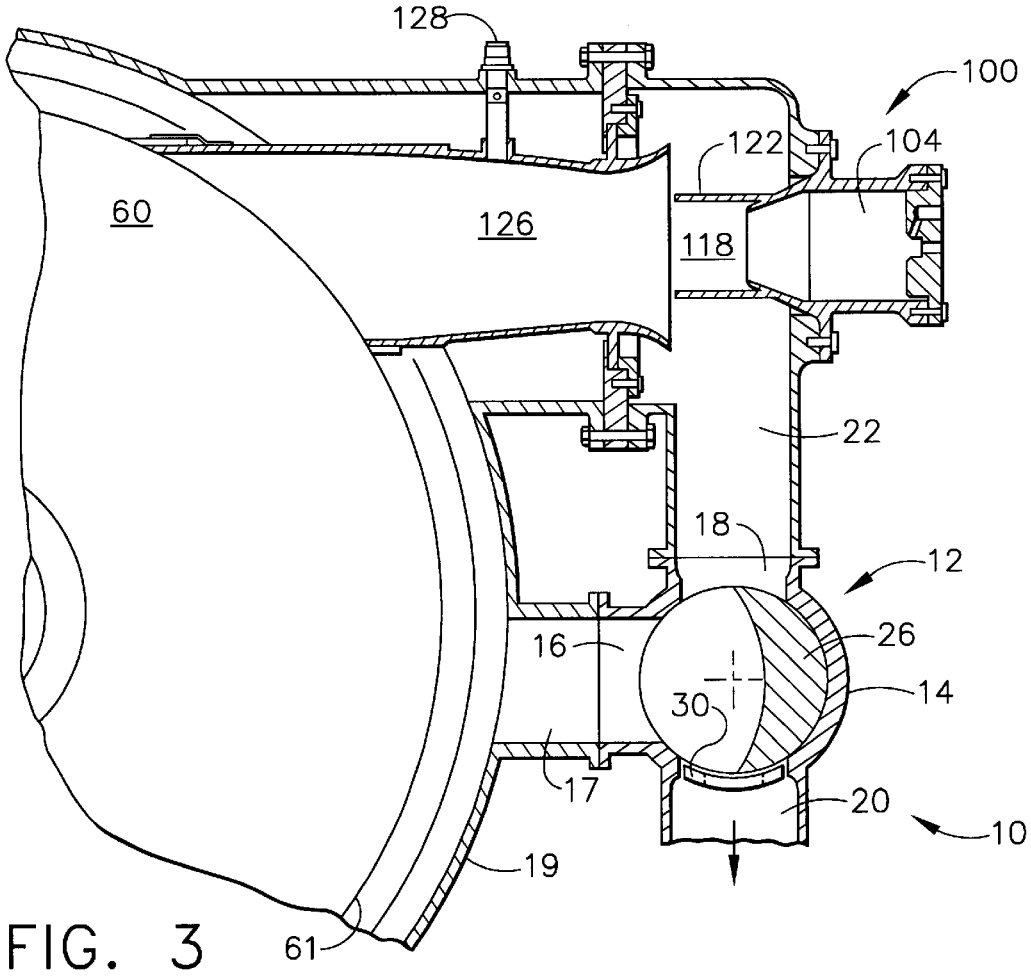
FIG. 3 depicts a sectional view one of the dilution bypass systems.
Figure 4:
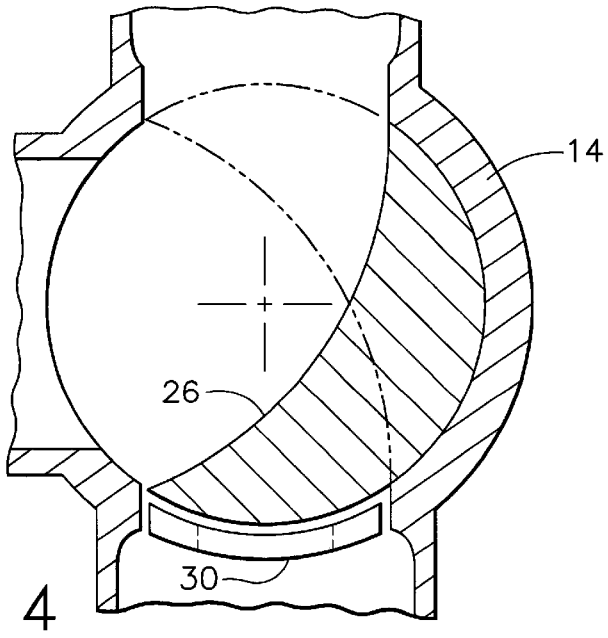
FIG. 4 depicts an enlarged fragmentary sectional view of a portion of FIG. 3.
Figure 5:
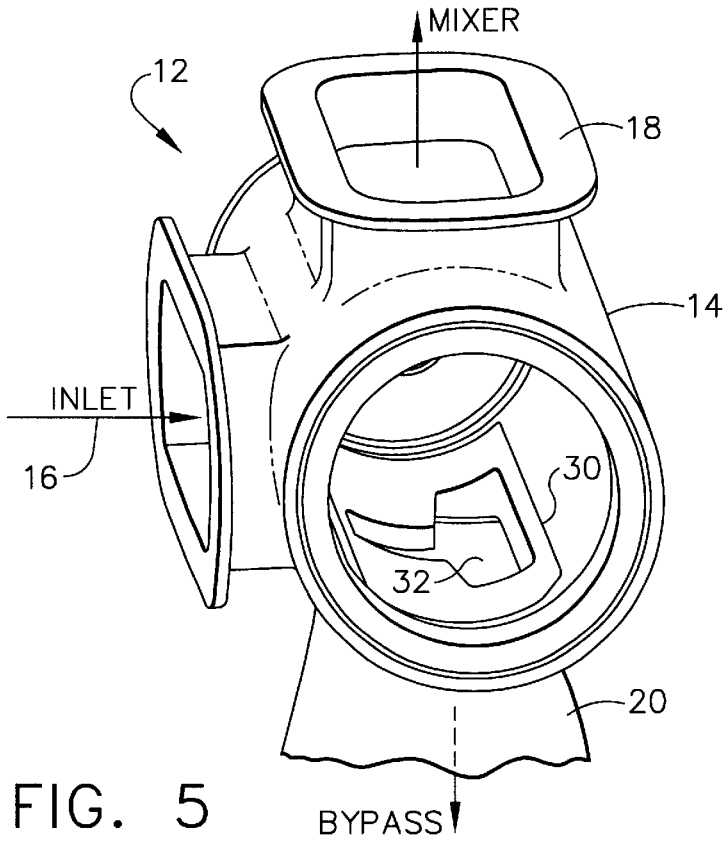
FIG. 5 depicts a perspective view of an air valve.

Referring to FIGS. 2 through 4, the air valve 12 comprises a cylindrical housing 14 defining an inlet port 16, and two exit ports 18 and 20. Inlet port 16 is connected to an inlet duct 17 for receiving compressed air from the combustor plenum 19 that circumscribes the combustion chamber 60 which is defined by a combustor wall 61. Exit port 18 connects to the premixer duct 22 which leads to the premixer injector 100 that injects tangentially a mixture of fuel and air into the combustion chamber 60. Exit port 20 connects to the bypass duct 24. The air valve 12 includes a crescent shaped rotatable valve rotor 26 for selectively controlling the relative proportions of airflow to premixer duct 22 and bypass duct 24.

This flow distributing or dividing function of the air valve can be best visualized by referring to FIGS. 3 and 4. As shown in FIG. 4, when valve rotor 26 is in the idle position, (broken line), most of the airflow is directed to bypass duct 24, and very little is directed to the premixer duct 22. Conversely, at maximum power condition, (solid line), most of the airflow is directed to the premixer duct 22, and very little to the bypass duct 24. FIG. 3 depicts an intermediate power setting wherein the air valve plate 26 is positioned to evenly divide the flow between the premixer duct and bypass duct. As evident from the drawings, the crescent shape of the rotatable valve rotor 26 provides for a smooth and efficient air flowpath from inlet port 16 to either of the exit ports 18 or 20, particularly at idle and max power conditions.

Figure 6:
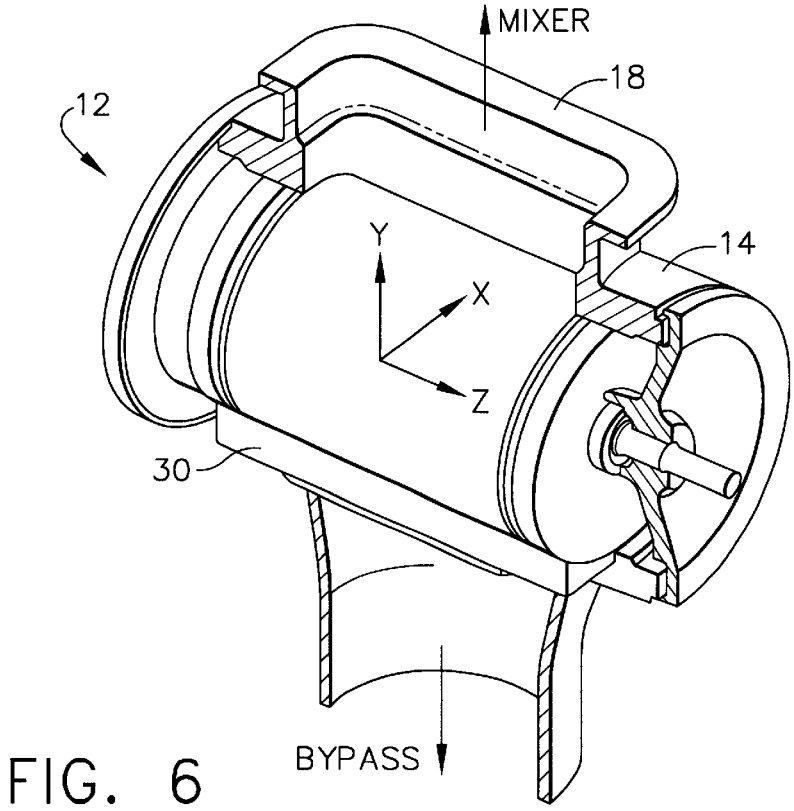
FIG. 6 depicts a partial cut-away perspective view of the air valve of FIG. 5.
Figure 7:
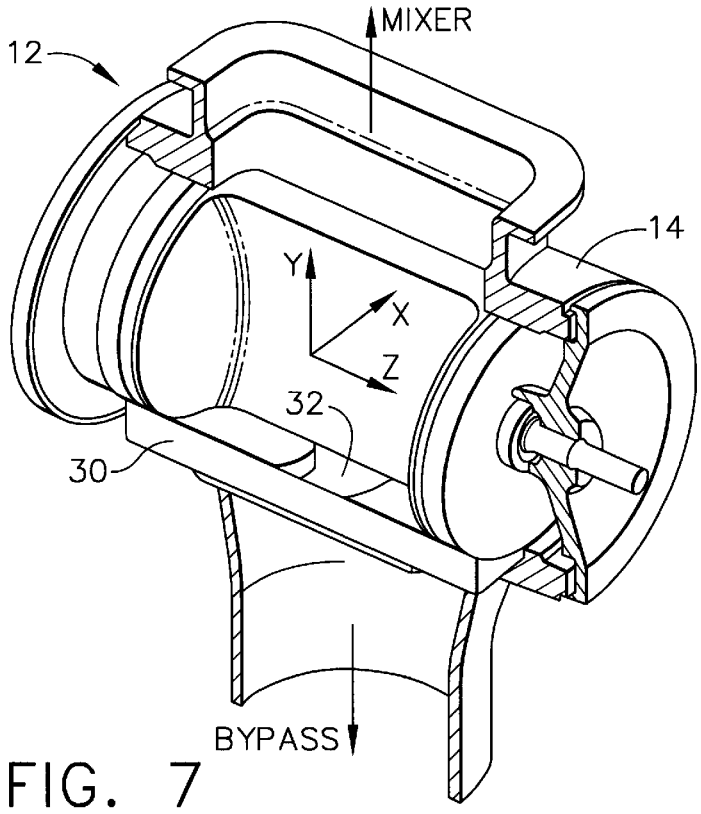
FIG. 7 depicts another partial cut-away perspective view of the air valve of FIG. 5.
Figure 8:
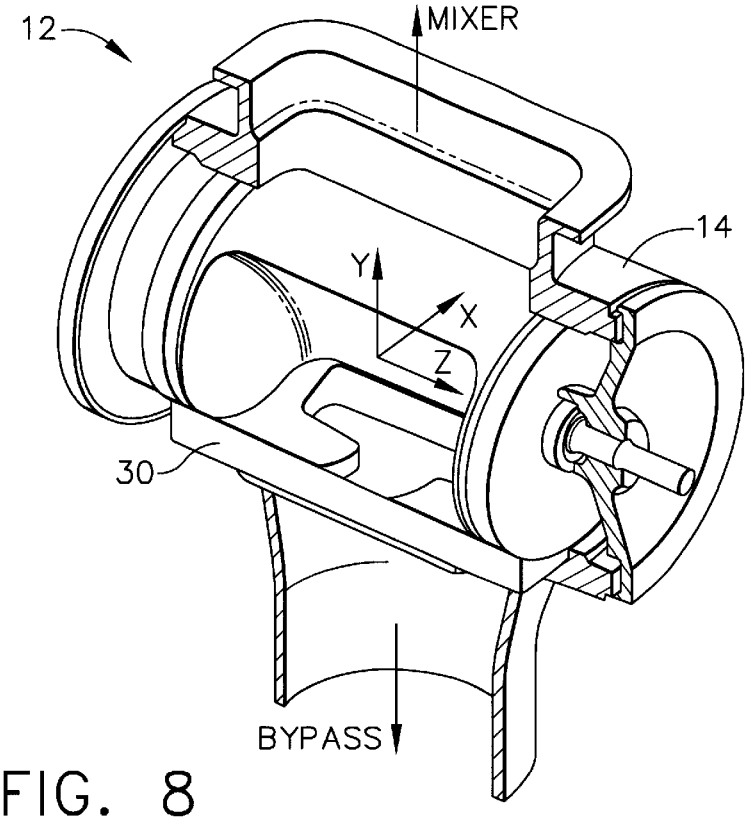
FIG. 8 depicts a third partial cut-away perspective view of the air valve of FIG. 5.

Referring now to FIGS. 5–8, valve 12 further comprises an exchangeable bypass orifice plate 30 replaceably mounted in the exit port 20. To maintain a constant pressure drop across the combustor and to assure that the right amount of air flows to the premixer injector 64 requires controlling or scheduling the ratio of air supplied to the premixer duct 22 and to the bypass duct 24. The bypass orifice plate 30 includes a variable width orifice 32 for this purpose. By shaping the orifice 32, the ratio of the flow areas of the bypass port to the premixer port can be controlled, and thereby control the ratio of air supplied to each. FIGS. 6 through 8 show valve rotor 26 exposing orifice plate 30 to varying degrees for three power settings. FIG. 6 shows the maximum power condition where the orifice plate is covered. FIG. 7 shows an intermediate percent power condition where the orifice plate is approximately half opened. Finally, FIG. 8 shows the low power condition where the orifice plate is fully opened and the flow to the premixer injector 64 is reduced. The shape and dimensions of the orifice plate 32 are selected, in a manner familiar to those skilled in the art, for the particular engine design or installation, or desired pressure drop changes at low power conditions. It should be appreciated that the orifice plate is not essential the present invention.

Figure 9:
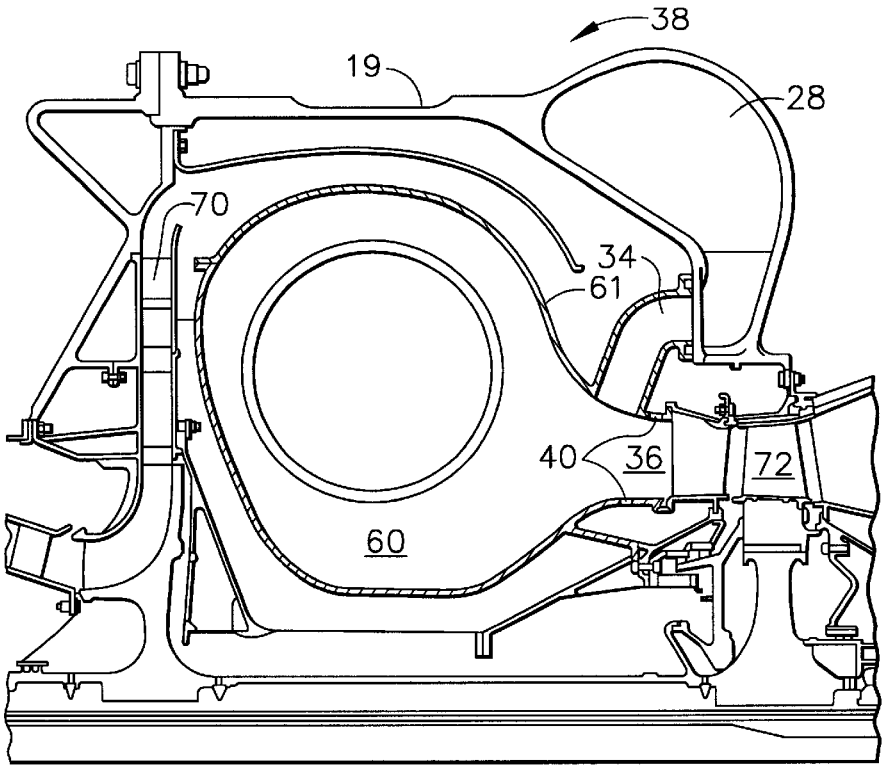
FIG. 9 depicts a transverse sectional view of the combustion system of FIG. 1.
Figure 10:
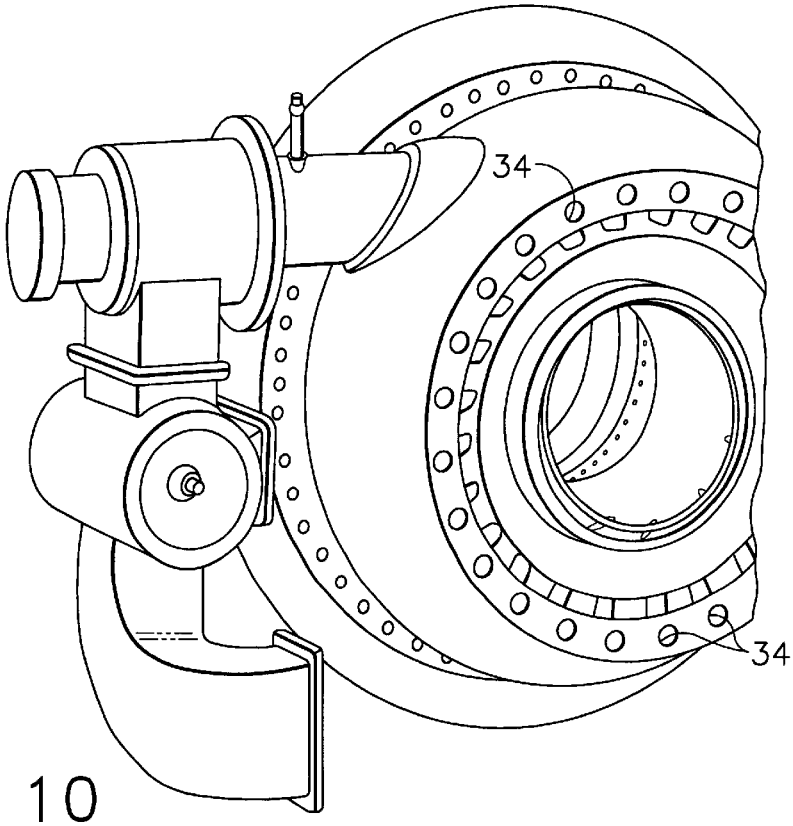
FIG. 10 depicts a perspective view of a portion of the combustion system and dilution bypass system of FIG. 1.

Referring to FIG. 9, compressed air from compressor 70 enters the combustor plenum 19. As previously described a portion of this air flows from the plenum 19 through the bypass 13. The bypass 13 further includes an annular bypass manifold 28 which receives air from bypass ducts 24. A plurality of tubes 34 extend from and connect bypass manifold 28 to the dilution zone 36 of combustor chamber 60. Together, the air valve 12, bypass ducts 24, bypass manifold 28, and tubes 34 provide a clear flowpath with minimal pressure drop for routing compressed air directly from the compressor exit to the dilution zone 36 in generally the same location has the dilution ports 40 just upstream of a turbine 72. Independent of the bypassed air, the dilution ports 40 also receive air from plenum 19.

Figure 11:
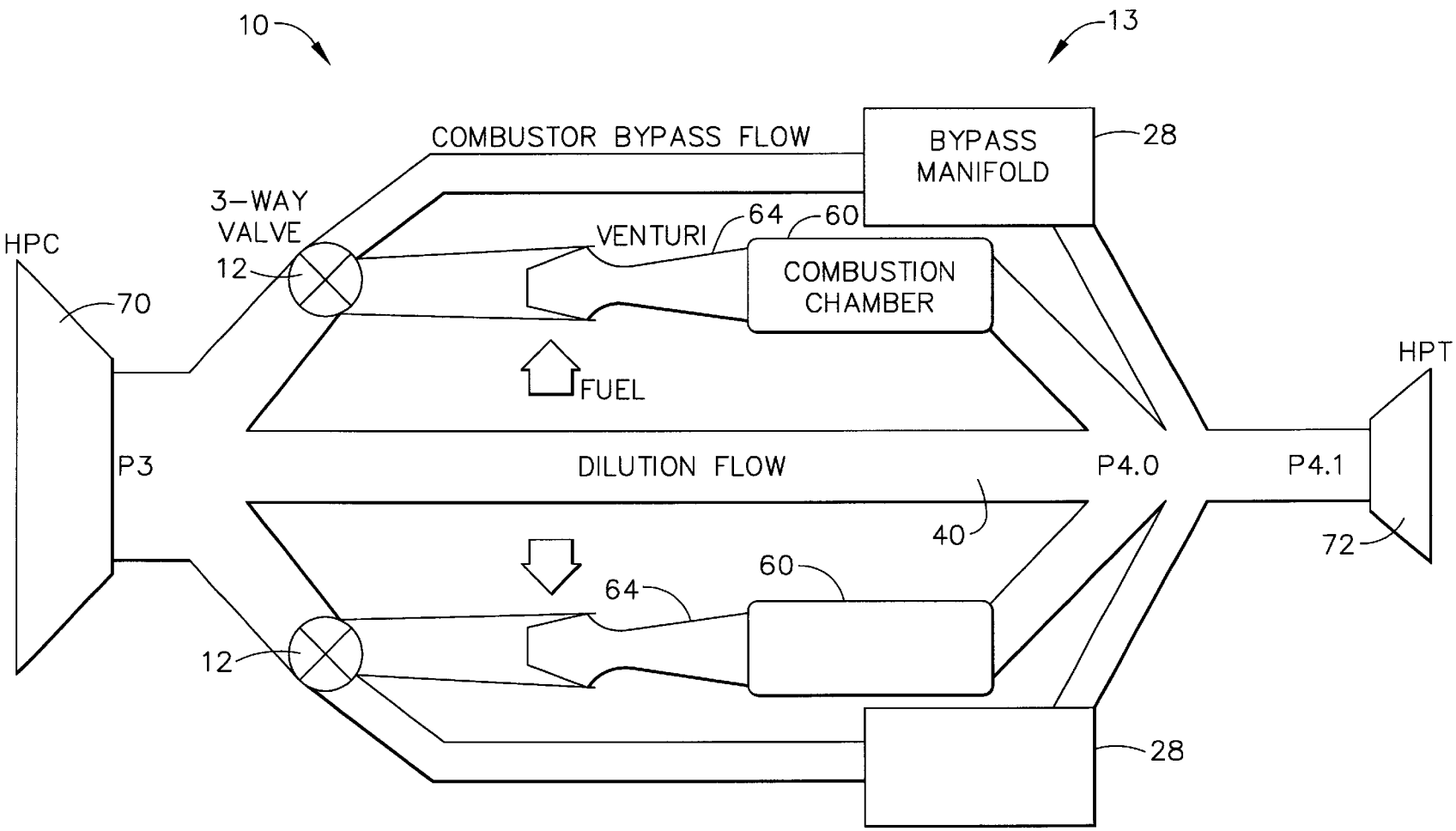
FIG. 11 depicts a schematic view of the dilution bypass systems of FIG. 1.

FIG. 11 shows schematically how the two bypass systems 10 operate. At maximum power condition, the path to the bypass 13 is closed off, forcing most of the air to the premixer injector 64 and through the combustor chamber 60. Any excess air is then indirectly caused to re-enter the gas flowpath through the dilution ports 40 surrounding the dilution zone 36. Dilution ports 40 are sized for providing efficient flow at this maximum power setting, and so as to produce the desired pressure drop across the combustor. In this condition, the bypass is essentially not utilized.

As power is decreased from maximum, air valve 12 is rotated closing off the port 18 leading to the premixer injector. Although fuel flow is substantially reduced at low power conditions, the total airflow volume being pumped by the compressor is not reduced in the same proportion. Thus at low power, to maintain the correct fuel to air ratio in the premixers, the volume of excess air, i.e. air not going to the premixer injector increases dramatically. Were it not for the bypass 13, all of the excess air would be directed through the dilution ports 40 resulting in a larger than desired pressure drop across the combustor. However by simultaneously opening the alternate path through the bypass duct, the three way air valves allow for the large flow of low power excess air to reach the dilution zone 36 without having to flow through the overly restrictive dilution ports. Rather, the flow is divided, with an appropriate amount flowing through dilution ports 40, and the majority of the excess air flowing through the bypass. Through use of the bypass orifice plate 30, the proper distribution of bypass air, to air through ports 40 can be achieved such that the combustor pressure drop is maintained constant for all operating conditions or can be adjusted as desired at low power settings.

Figure 12:
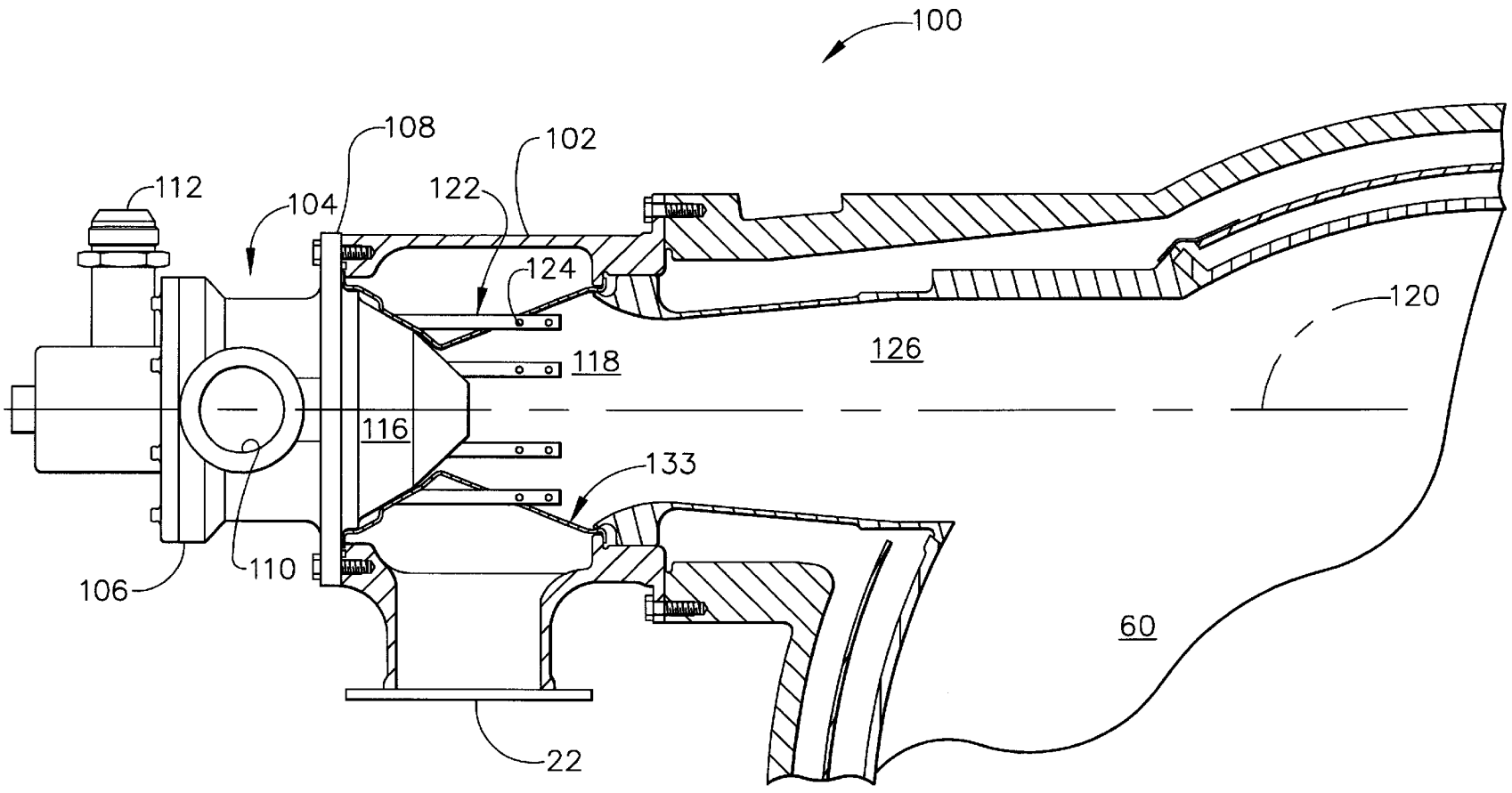
FIG. 12 is a cross section of the premix injector as contemplated by the present invention.
Figure 13:
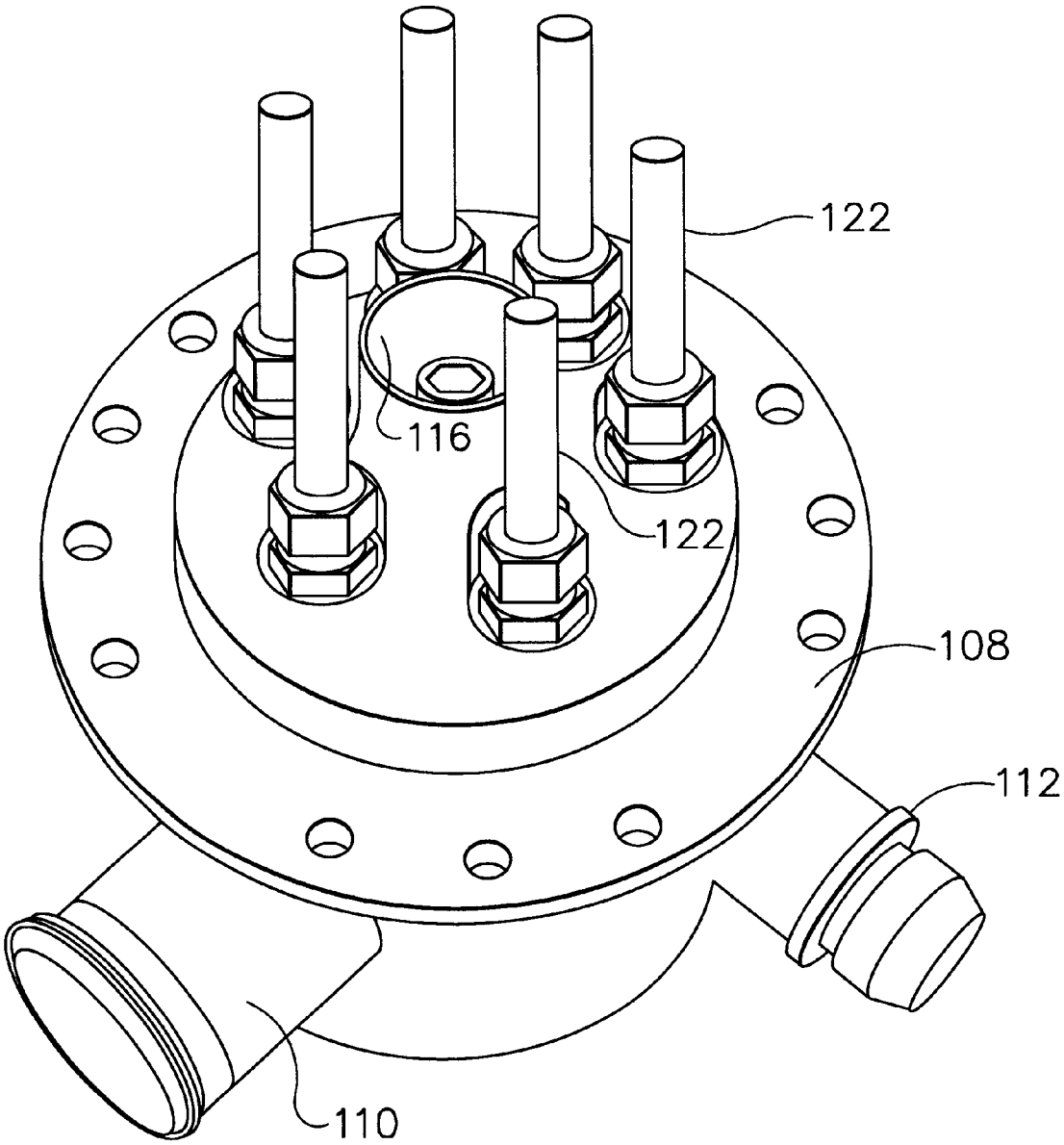
FIG. 13 is a perspective view of a portion of the premix injector of FIG. 12.

Referring to FIGS. 12 and 13, the premix injector 100 includes a gaseous fuel injector 104 with a body 106 having flange 108 that is bolted to the premix injector casing 102. The fuel injector 104 has gas fuel inlet port 112. The fuel injector also has a commercially available air blast nozzle 116 that injects liquid fuel into the premix chamber 118 along an axial centerline 120 of the premix injector 100. The fuel injector has an air inlet port 110 which communicates with a plenum 19, (not shown). This provides air to assist the atomization of the liquid fuel. Mounted to the body 106 and extending into the premix chamber 118 are a plurality of circumferentially disposed fuel injector tubes 122. Each tube is generally cylindrical and closed at the end disposed in the premix chamber 118. Each tube 122 also has a plurality of holes 124 which are also referred to as fuel injection ports. The ports 124 are disposed along the length of each of the tubes 122. Some of the holes are directed towards the centerline while others can be angled away from the centerline 120 in the tangential direction. In the preferred embodiment, there are six tubes 122 equally spaced apart and circumscribing the nozzle 116. The number and spacing of the tubes as well as the number of holes 124 and their angular position will of course vary from application to application. In a manner familiar to those skilled in the art, the body 106 has internal passages, not shown, for delivering a gaseous fuel from inlet port 112 to each of the tubes 122 and other passages for delivering air and liquid fuel to the air blast nozzle 116.

The premix injector also includes a venturi 126 downstream of the premix chamber 118. The venturi 126 is a tube that tapers outward as it extends from an inlet to an exit and is symmetric about the centerline 120. The inlet of the venturi is in fluid communication with the premix chamber 118 and its exit is in fluid communication with the combustion chamber 60. The venturi has a boss for receiving an igniter 128, shown in FIG. 3.

In operation, gaseous fuel enters the premix chamber 118 through the tubes 122. At the same time air enters the premix chamber 118 from the premixer duct 22. The fuel and air mixing process is completed in the venturi 126 to form a premixed gas that enters the combustion chamber 60. Because the gaseous fuel entering through the tubes 122 is not concentrated around the centerline 120, the air entering from duct 22 cannot trap the gas and as result there is improved mixing of the fuel and air.

To further enhance the mixing of the fuel and air, a mixing screen 133 can be disposed between the duct 22 and the premix chamber 118. If the screen 118 is used, the tubes 122 should extend through the screen 118 so that all the holes 124 are downstream of the screen.

Figure 14:
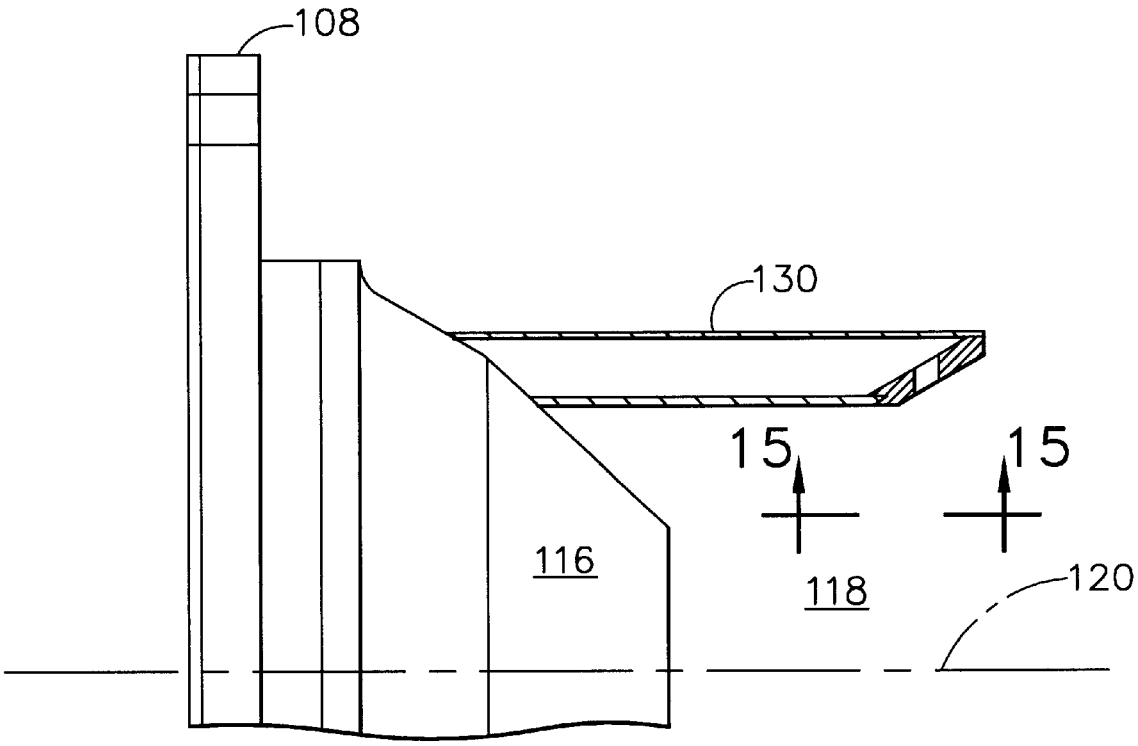
FIG. 14 is a cross section of an alternative embodiment of the premix injector contemplated by the present invention.
Figure 15:
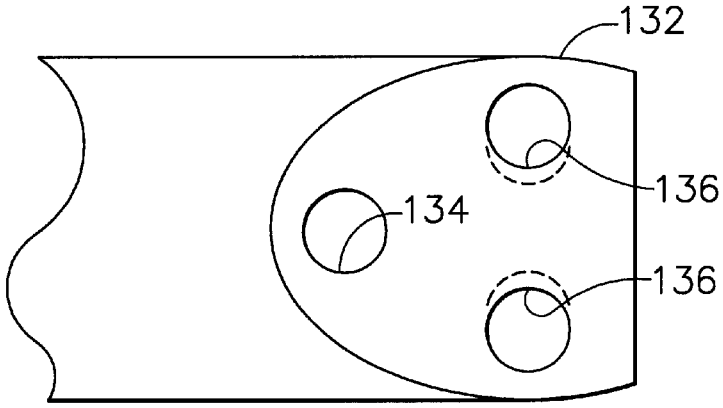
FIG. 15 is a view taken along line 15—15 of FIG. 14.

FIGS. 14 and 15 show an alternative embodiment 130 of the tubes 122. The tubes 130 are cylindrical but have an angled end 132 disposed in the premix chamber 118. The angle of the ends 132 is about 33 degrees from the centerline 120. Each of the ends 132 has a first radial facing hole 134 and two holes 136 angled an equal amount from the radial direction about 20 degrees. The holes 136 are coplanar with each other but not with the hole 134.

Figure 16:
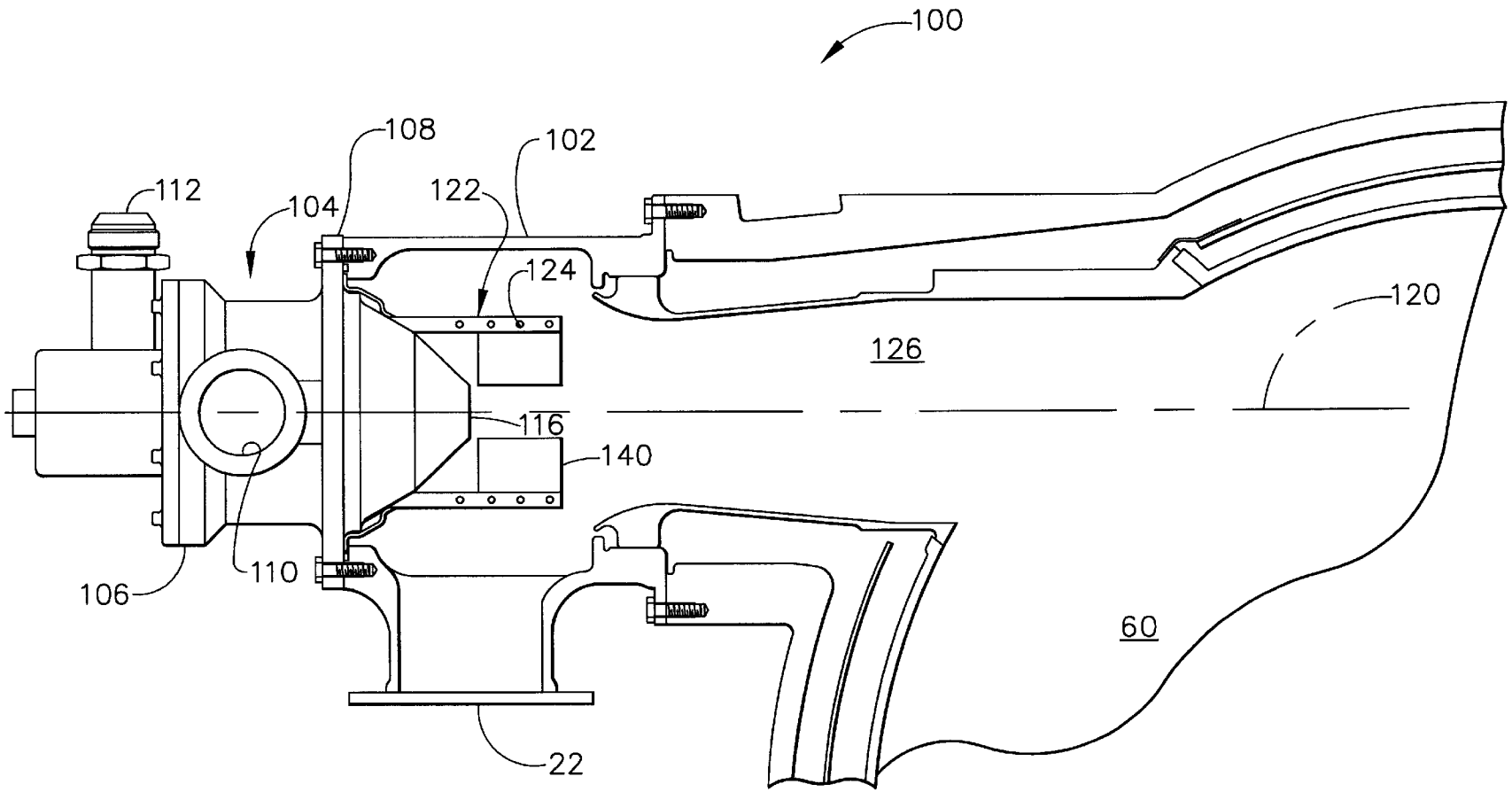
FIG. 16 is a cross section of yet another alternative embodiment of the premix injector contemplated by the present invention.

FIG. 16 shows another embodiment of the present invention where swirling vanes 140 are mounted to each of the tubes 122 and extend inward therefrom. The gaseous fuel mixes with the air in the passages between the vanes 140 and then flows to the venturi 126, Besides enhancing fuel-air mixing, the vanes also inhibit flashback of the flame into the premix chamber 118 as a result of improved air feed to the venturi inlet and by the promotion of positive, forward flowing mixture velocities along the venturi wall as a result of the swirl. The vanes 140 can also be used with the embodiment shown in FIGS. 14 and 15.

Various modifications and alterations of the above described sealing apparatus will be apparent to those skilled in the art. Accordingly, the foregoing detailed description of the preferred embodiment of the invention should be considered exemplary in nature and not as limiting to the scope and spirit of the invention.

What is claimed is:

1. A premix fuel injector for injecting a mixture of gaseous fuel and air into a combustion chamber comprising:

a premix chamber having an inlet for receiving a flow of pressurized air and having an exit;

a venturi in fluid communication with said exit of said premix chamber and an inlet of said combustion chamber; and a fuel injector having a plurality of circumferentially disposed tubes extending into said premix chamber each of said tubes having at least one hole for flowing a stream of said gaseous fuel into said premix chamber.

2. The premix fuel injector of claim 1 further comprising an air blast nozzle for injecting liquid fuel into said premix chamber along an axial centerline of said premix chamber.

3. The premix fuel injector of claim 1 wherein each of said tubes has a plurality of holes for flowing said stream of said gaseous fuel.

4. The premix fuel injector of claim 3 wherein a first portion of said plurality of holes are directed towards said axial centerline and a second portion of said plurality of holes are directed at an angle away from said axial centerline in the tangential direction.

5. The premix fuel injector of claim 4 further comprising a mixing screen disposed at said inlet of said premix chamber and said tubes disposed so that all of said holes are downstream of said screen.

6. The premix fuel injector of claim 1 wherein each of said tubes as an angled end disposed in said premix chamber 118.

7. The premix fuel injector of claim 6 wherein each of said ends has a first radial facing hole and at least two other holes angled an equal amount from the radial direction.

8. The premix fuel injector of claim 7 wherein said angles holes are coplanar.

9. The premix fuel injector of claim 1 further comprising a swirling vanes mounted to at least one of said tubes and extending inward therefrom.

10. The premix fuel injector of claim 1 further comprising an igniter disposed in said venturi.

11. A gas turbine engine comprising:

a compressor providing pressurized air;

a turbine for expanding a hot gas;

a combustor disposed between said compressor and said turbine; said combustor comprising:

a combustion chamber defined by a combustor wall;

a plenum circumscribing said combustor wall and receiving said pressurized air from said compressor;

a premix fuel injector for injecting a mixture of gaseous fuel and air into said combustion chamber, said premix fuel injector comprising: a premix chamber having an inlet for receiving a flow of pressurized air from said plenum and having an exit; a venturi in fluid communication with said exit of said premix chamber and an inlet of said combustion chamber; and a fuel injector having a plurality of circumferentially disposed tubes extending into said premix chamber each of said tubes having at least one hole for flowing a stream of said gaseous fuel into said premix chamber;

an igniter disposed in said venturi for igniting said fuel and air mixture;

a dilution zone just upstream of said turbine, said dilution zone receiving a portion of the air in said plenum through at least one dilution hole; and a bypass system for controlling the flow of the remaining portion of said air in said plenum to said injector and said dilution zone.

12. The gas turbine engine of claim 11 wherein said bypass system includes:

a first conduit extending from said plenum;

a second conduit in fluid communication with said first conduit and said premix fuel injector;

a third conduit in fluid communication with said first conduit and said dilution zone; and an air valve disposed between said first, second, and third conduits for directing the flow of air from said plenum to said premix fuel injector.

13. The gas turbine of claim 12 wherein said valve comprises:

a housing having a first port connected to said first conduit, a second port connected to said second conduit and a third port connected to said third conduit; and an air valve rotor rotatably mounted to said housing.

14. The gas turbine of claim 13 wherein said valve rotor is crescent shaped.

15. The gas turbine engine of claim 13 wherein said valve includes an exchangeable orifice plate mounted in said third port.

16. The gas turbine engine of claim 12 further comprising an annular bypass manifold in fluid communication with said third conduit and a plurality of tubes extending from said bypass manifold to said dilution zone.

17. A combustion system with a controllable pressure drop thereacross, comprising:

a combustion chamber defined by a combustor wall and having an inlet and an exit;

a plenum circumferentially disposed about said combustor wall and receiving pressurized air;

a premix fuel injector for injecting a mixture of gaseous fuel and air into said combustion chamber, said premix fuel injector comprising: a premix chamber having an inlet for receiving a flow of pressurized air from said plenum and having an exit; a venturi in fluid communication with said exit of said premix chamber and an inlet of said combustion chamber; and a fuel injector having a plurality of circumferentially disposed tubes extending into said premix chamber each of said tubes having at least one hole for flowing a stream of said gaseous fuel into said premix chamber;

an igniter disposed in said venture for igniting said fuel and air mixture;

a dilution zone just upstream of said exit, said dilution zone receiving a portion of the air in said plenum through at least one dilution hole in said combustor wall; and an adjustable bypass means for diverting to said dilution zone a portion of the air flowing from said plenum to said injector, whereby the magnitude of the diverted air can be varied to obtain a desired pressure drop across said combustion system.

18. The combustion system of claim 17 wherein said bypass means includes an air valve disposed between said plenum and said injector and said dilution zone.

19. The combustion system of claim 18 wherein said valve has a crescent shaped valve rotor.

20. The combustion system of claim 18 wherein said bypass means further includes:

a first conduit extending between said plenum and said valve;

a second conduit extending between said valve and said injector; and a third conduit extending from said valve to said dilution zone.

* * * * *